US005598895A

United States Patent [19]

Anderson et al.

[11] Patent Number: 5,598,895

[45] Date of Patent: Feb. 4, 1997

[54] CUTTER ASSEMBLY HAVING A PLURALITY OF INDEPENDENTLY ROTATABLE CUTTING UNITS THEREON

[75] Inventors: Llewellan Anderson, Renton; Gregory L. Hern, Auburn, both of Wash.

[73] Assignee: Atlas Copco Robbins Inc., Kent, Wash.

[21] Appl. No.: 374,808

[22] Filed: Jan. 19, 1995

[51] Int. Cl.[6] ..... E21B 9/08

[52] U.S. Cl. ..... 175/373; 175/352; 384/95

[58] Field of Search ..... 175/371, 372, 175/373, 374, 363, 364, 344, 351, 352; 299/86; 384/95

[56] References Cited

U.S. PATENT DOCUMENTS

| | | | |
|---|---|---|---|
| 2,063,012 | 12/1936 | Catland | 175/364 |
| 3,358,782 | 12/1967 | Bechem . | |
| 4,167,980 | 9/1979 | Saxman | 175/372 X |
| 4,193,464 | 3/1980 | Dixon | 175/372 X |
| 4,274,496 | 6/1981 | Liljekvist et al. | 175/57 |
| 4,298,080 | 11/1981 | Hignett | 175/373 |
| 4,399,879 | 8/1983 | Liljekvist et al. | 175/372 |
| 4,736,987 | 4/1988 | Lenzen et al. | 299/86 |
| 4,815,543 | 3/1989 | Lenzen et al. | 175/350 |
| 5,234,064 | 8/1993 | Lenaburg | 175/373 |

*Primary Examiner*—William P. Neuder

*Attorney, Agent, or Firm*—Graybeal Jackson Haley & Johnson

[57] ABSTRACT

A rock cutting tool with a plurality of independently rotatable cutter units and with a shaft, a sleeve located around the shaft, and at least two rotatable hubs located around the sleeve. At least one cutter unit is located on each of the two rotatable hubs for rotation about an axis of rotation with respect to a rock-face. Bearings between the sleeve and each of the hubs rotatably support the hubs. The bearings comprise at least one cylindrical roller bearing set and at least one ball bearing set for each hub. Each roller bearing set is located substantially entirely under the cutter unit of its associated hub to absorb radial loads, and each ball bearing set is located remotely from the cutter unit of its associated hub to be isolated from radial loads. The shaft has first and second key receiving openings. The key is located on the interior surface of the sleeve. The key is mateable with the first and second key receiving openings in the shaft whereby the sleeve is rotatable with respect to the shaft from a first position to a second position to disengage the key from the first key receiving opening and engage the key in a second key receiving opening to extend the bearing life.

17 Claims, 5 Drawing Sheets

CUTTER ASSEMBLY HAVING A PLURALITY OF INDEPENDENTLY ROTATABLE CUTTING UNITS THEREON

BACKGROUND OF THE INVENTION

The present invention pertains to rock cutter assemblies, and more specifically to rock cutter assemblies for use on raise boring apparatus wherein a plurality of independently rotatable cutting units are employed on the raise boring head.

U.S. Pat. Nos. 4,274,496 and 4,399,879 issued to Liljekvist disclose a cutter assembly with cutting means 53 in the form of hard metal inserts which are fitted in bores in the body of the cutter. The inserts 53 are positioned in rows 45–48 which extend circumferentially around the cutter. Multiple rows of cutting means 53 are required on each cutter because of the limited space near the center of any earth boring apparatus (raise reamer, tunnel borer, etc. ). FIG. 6 shows that each row of inserts 53 increases in diameter. The conical shape of the cutter is to limit the amount of skidding when the cutter rolls along the rock face. To totally eliminate the skidding would require changing the cone angle for each pair of cutters 13 and 14 so that the true rolling radius passes through the center of the reamer, which is not practical. If the cutter is located inside or outside of the true rolling radius, the cutting means 53 will skid. The skidding action significantly reduces the wear life of the cutting means. Also, the greater the distance between rows 45 and 48 the greater the skidding.

It is desirable to employ cutting units on a raise boring head with a minimum distance between rows, with a single row or disc being optimum. However, due to the small surface area of the raise boring head, there is not enough room thereon to place the requisite number of rotatable cutting units if each cutter assembly employs only a single disc.

U.S. Pat. No. 4,298,080, issued to Hignett discloses a rock cutter comprised of a pair of disc cutters 1 disposed in parallel and independently rotatable about tubular shaft support 2, the latter in turn being supported by a mounting pedestal 3. According to Hignett, the tool can be attached to the head of a tunnel boring machine, raise borer, or the like by fasteners 4. However, the cutter in Hignett employs thrust bearings to take the radial and thrust loads which occur during rock boring. The thrust loads induced into the thrust bearing are reacted by the end of the tapered rollers sliding against the guide flange on the bearing cone. This sliding action creates frictional heat which is detrimental to the life of the lubricant. The sliding action is particularly negative in rock cutter assemblies because the bearings rotate very slowly and are subjected to excessive impact loads. Both the high loading and slow rotation allows the lubrication film between the end of the tapered rollers and the guide flange to dissipate or break down. The lack of lubrication increases the amount of heat created by the sliding action. More importantly, in a rock cutting application, if muck contaminates the bearing cavity, the contaminates will prevent the sliding action which will invariably lock up the bearings.

Similarly, Atlas Copco has manufactured a cutter assembly for use in tunnel boring having a plurality of rotatable cutting units thereon which, as in Hignett, employ tapered roller bearings or thrust bearings, as disclosed in Atlas Copco Design No. 5107600040. An additional disadvantage with the use of tapered roller bearings is that, while the overall length of the cutter assembly is less than a plurality of cutter assemblies having individual cutting units, the length of the Atlas Copco and Hignett cutter assemblies are still excessive due to the use of tapered roller bearings.

U.S. Pat. No. 3,358,782 issued to Bechem, discloses a cutter assembly for use in bore hole enlargement. As shown in FIG. 1 of Bechem, the cutter assembly includes a spindle 12 with a plurality of cutting ribs 10, 14 and 17 thereon, which rotate independently around spindle 12. Unlike the above cutters where the two or more cutting units are rotatable on separate bearings, the cutting ribs of Bechem are configured such that each cutting rib rotates on a sleeve portion of the neighboring cutting rib with the cutting ribs having increasing diameters.

U.S. Pat. Nos. 4,815,543 and 4,736,987, both issued to Lenzen et al., disclose rock cutting assemblies having a drive shaft 10 and two rollers 12 and 14, the axes of which are displaced with respect to each other. Rollers 12 and 14 include hub portions 16 and 18, respectively, which are integral with shaft 10, and peripheral annuli (cutters) 20 and 22 which are rotatably mounted on the hubs 16 and 18 on suitable bearings 24. It is important to note that the axes of the two rollers in Lenzen et al. are displaced and are not colinear.

A need thus exists for a raise boring cutter assembly having a plurality of independently rotatable cutter units thereon such that a sufficient number of cutter units can be loaded onto the raise bore head.

A need also exists for the above type of cutter assembly wherein the overall length of the cutter assembly is minimized in order to maximize the number of cutter units that can be configured on the raise bore head.

A need also exists for the above type of cutter assembly in which the bearing type and configuration is maximized to decrease the likelihood of lock-up and minimize the generation of heat due to friction.

A need further exists for the above type of cutter wherein bearing life can be extended by providing a rotatable bearing surface.

SUMMARY OF THE INVENTION

A rock cutting tool having a plurality of independently rotatable cutter units thereon includes a shaft, a sleeve located around the shaft, and at least two rotatable hubs located around the sleeve. At least one cutter unit is located on each of the two rotatable hubs for rotation about an axis of rotation with respect to the rock face. Bearings between the sleeve and each of the hubs rotatably support the hubs. The bearings preferably comprise at least one cylindrical roller bearing set and at least one ball bearing set for each of the hubs. Each roller being is located substantially entirely under the cutter of the associated hub to absorb radial loads, and each ball bearing is located remotely from the cutter of the associated hub to be isolated for radial loads. Most preferably two independently rotatable hubs are present, with one ball bearing set for each of the two hubs and two cylindrical roller bearing sets for each of the two hubs.

The shaft has first and second key receiving openings on its exterior surface. The key is located on the interior surface of the sleeve. The key is matable with the first and second key receiving openings in the shaft whereby the sleeve is rotatable with respect to the shaft from a first position to disengage the key from the first key receiving opening and engage the key in the second key receiving opening to extend the bearing surface life.

Most preferably, the first and second key receiving openings are longitudinal slots on substantially opposite sides of the shaft, about 150° apart, for example. Additionally a bearing loading orifice is located on the interior of the sleeve and the key is sized to fit the bearing loading orifice to function as a cap therefor. The shaft preferably is comprised of two coaxially adjoining portions, a left hand portion and a right hand portion, whereby one of the two coaxially adjoining portions has a larger diameter than that of the other in order to simplify alignment of the key in one of the first and second key receiving openings when the sleeve is rotated with respect to the shaft.

BRIEF DESCRIPTION OF THE DRAWINGS

These and other features of the present invention will be evident when considered in light of the following specification and drawings in which.

DETAILED DESCRIPTION OF THE PREFERRED EMBODIMENTS

Figure 1:
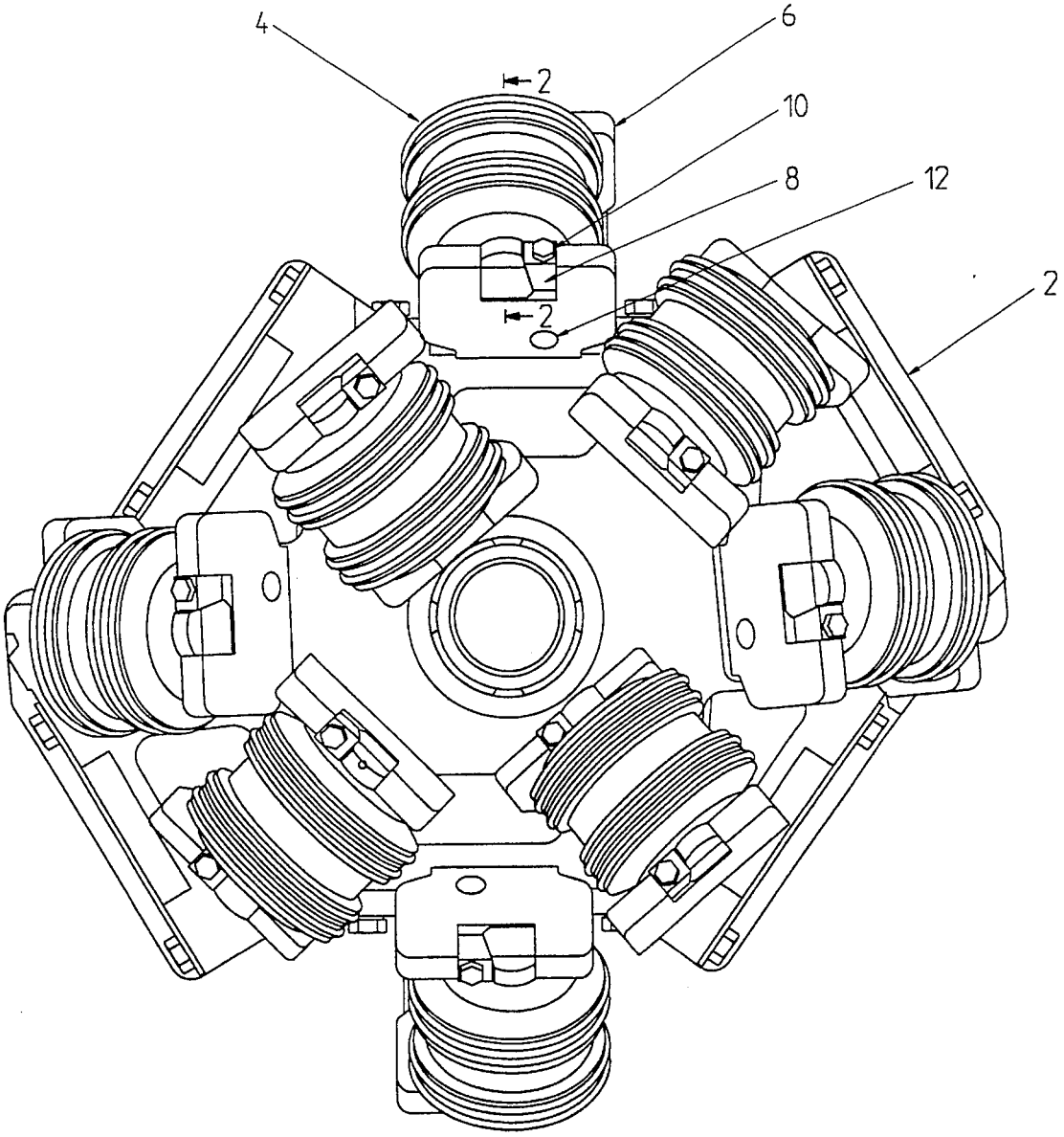
FIG. 1 is a perspective view of a raise boring head having the cutters of the present invention thereon.
Figure 2:
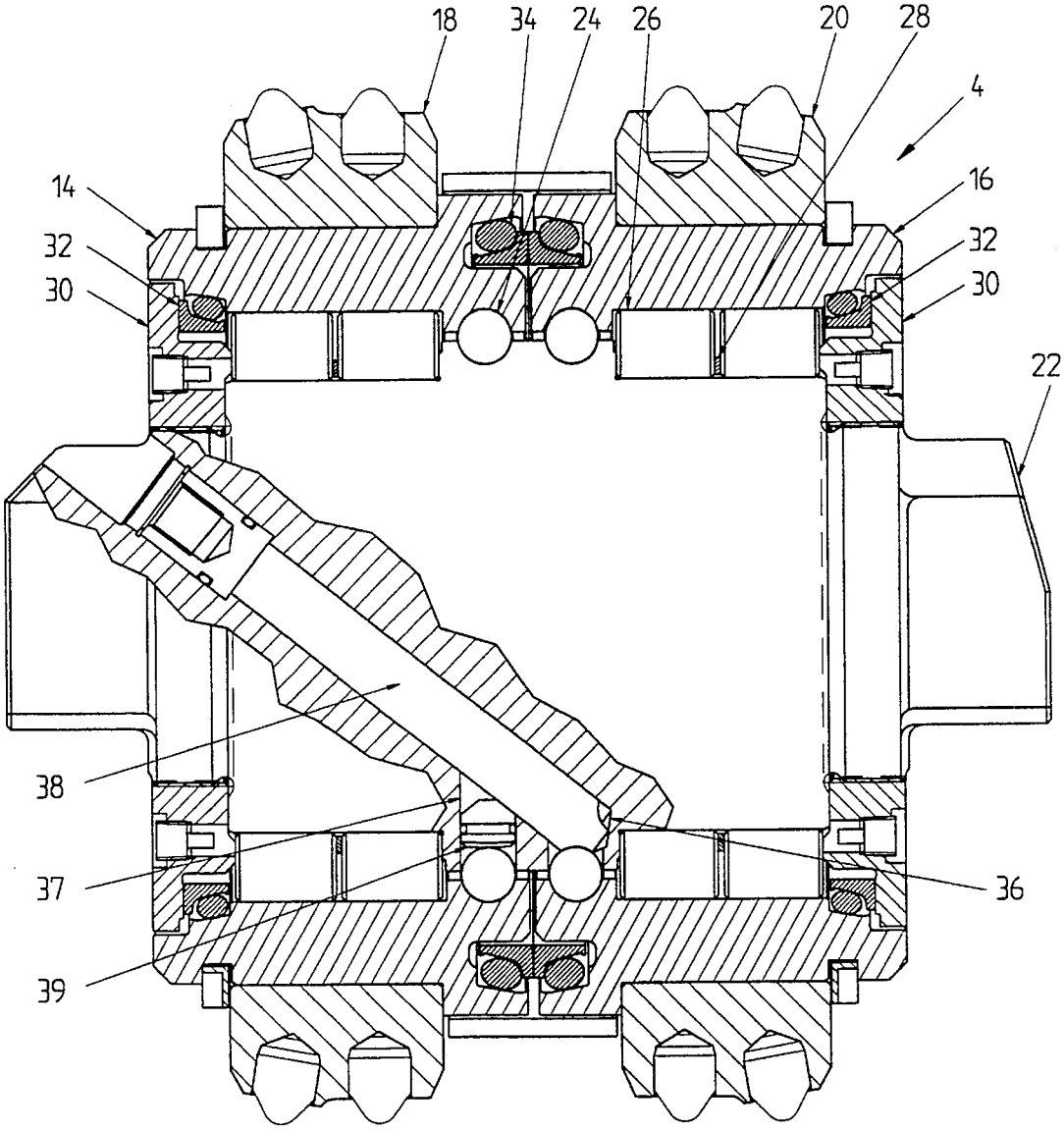
FIG. 2 is a cross section of a cutter typifying the first embodiment of the present invention taken along line 2—2 of FIG. 1.

Referring to FIGS. 1 and 2, the first embodiment of the present invention is shown. FIG. 1 shows an exemplary down reaming head 2 having a plurality of cutter assemblies 4 of the present invention thereon. Each cutter assembly 4 is mounted in a housing 6 and is secured therein by a wedge 8 which is fastened by a retaining bolt 10 and barrel nut 12.

Referring now to FIG. 2, the first embodiment of the present invention is shown in detail. Cutter assembly 4 includes two or more hubs, or cutter mountings, 14 and 16 which each support one or more independent cutter units 18 and 20. Cutter units 18 and 20 are replaceable discs comprised of steel, single row carbide, or double row carbide, depending upon the type of rock formation being cut. The discs of cutting units 18 and 20 can optionally include a plurality of carbide inserts thereon.

Hubs 14 and 16 are rotatably attached to shaft 22 by a plurality of ball bearings 24 and cylindrical roller bearings 26. Ball bearings 24 hold hubs 14 and 16 in position axially and roller bearings 26 support hubs 14 and 16 to absorb radial loads. While only one set can be employed, at least two sets of cylindrical roller bearings 26 are preferably present for each of hubs 14 and 16. The sets of cylindrical roller bearings 26 are separated by spacer 28 that prevents the interior ends of the two sets of cylindrical roller bearings 26 from contacting each other. The exterior end of the interior cylindrical roller bearing 26 is held in place by shaft 22, and the exterior end of the exterior cylindrical roller bearing 26 is held in place by seal retainer 30.

An important aspect of the present invention is that each cylindrical roller bearing 26 is located substantially entirely under its respective cutter unit 18 or 20 to absorb radial loads, and each ball bearing 24 is located remotely from (i.e. not directly under) its respective cutter unit 18 or 20 to be isolated from radial loads. Additionally, by placing cylindrical roller bearings 26 substantially entirely under cutter units 18 and 20, radial loads from contacting the rock face go directly into cylindrical roller bearings 26 and overhanging loads on cylindrical roller bearings 26 are avoided. Also of importance is the use per se of the combination of ball bearings and cylindrical roller bearings. As stated above, prior art cutters with two or more independently rotatable cutter units employed tapered roller bearings which are more likely to lock up when contaminates infiltrate the bearing cavity and prevent the tapered roller bearing from sliding on the bearing cone guide flange. In contrast, the rolling action of the ball bearings 24 can tolerate significantly more contamination than the sliding action typified in the prior art tapered roller bearings, or thrust bearing.

The cavity in which ball bearings 24 and cylindrical roller bearings 26 are located is sealed at both external ends by half seal 32 and seal retainer 30. Center seal 34 is a two-piece, or full, seal, one-half of which is pressed into each of hubs 14 and 16.

Ball bearings 24 are loaded between hubs 14 and 16 and shaft 22 by means of ball loading holes 36 and 37. Ball plugs 38 and 39 secure ball bearings 24 between hubs 14 and 16 and shaft 22.

Figure 3:
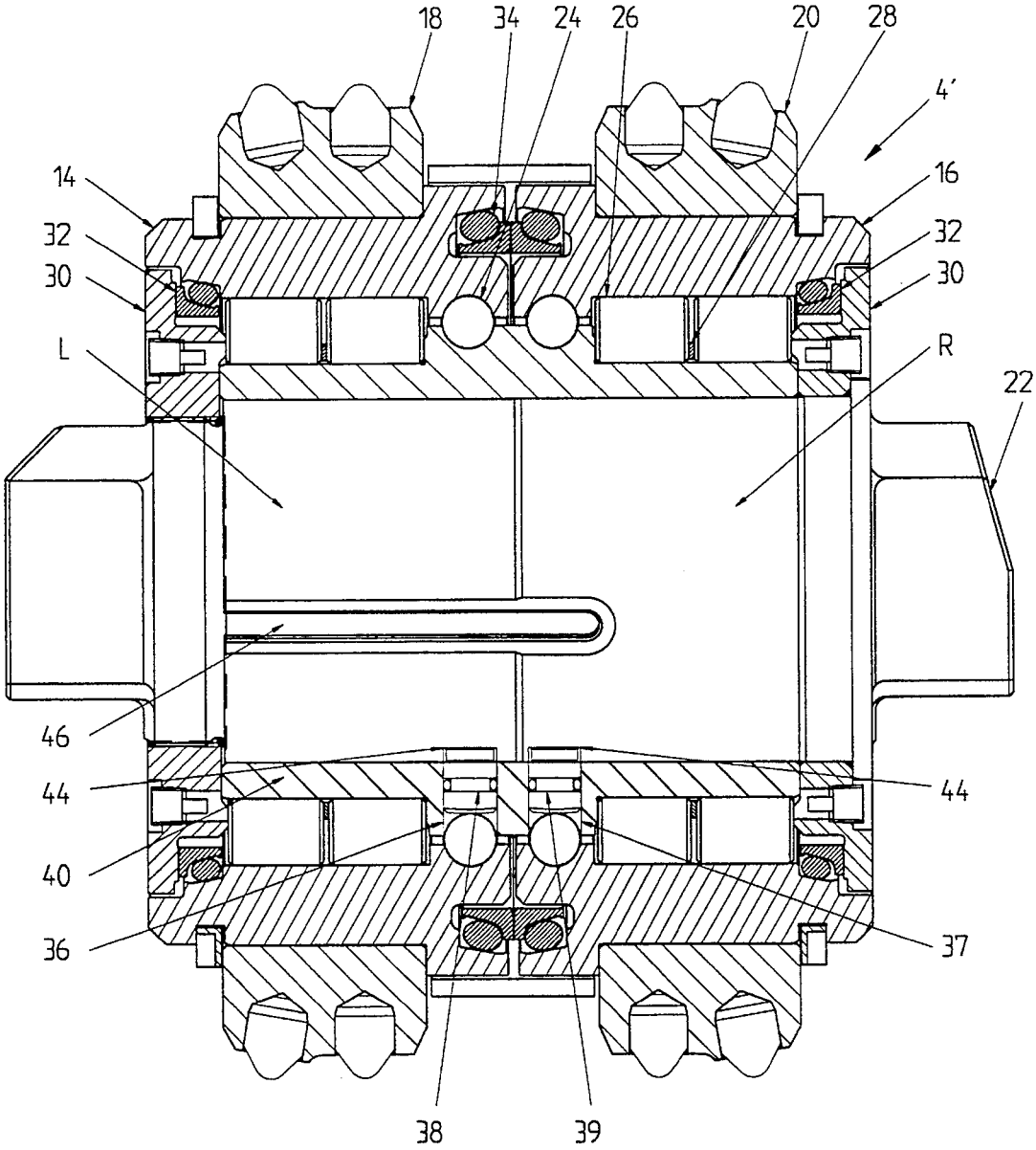
FIG. 3 is a cross section of a cutter typifying the second embodiment of the present invention which is substantially similar to FIG. 2 except for the addition of a rotating sleeve which is employed to increase bearing life.
Figure 4:
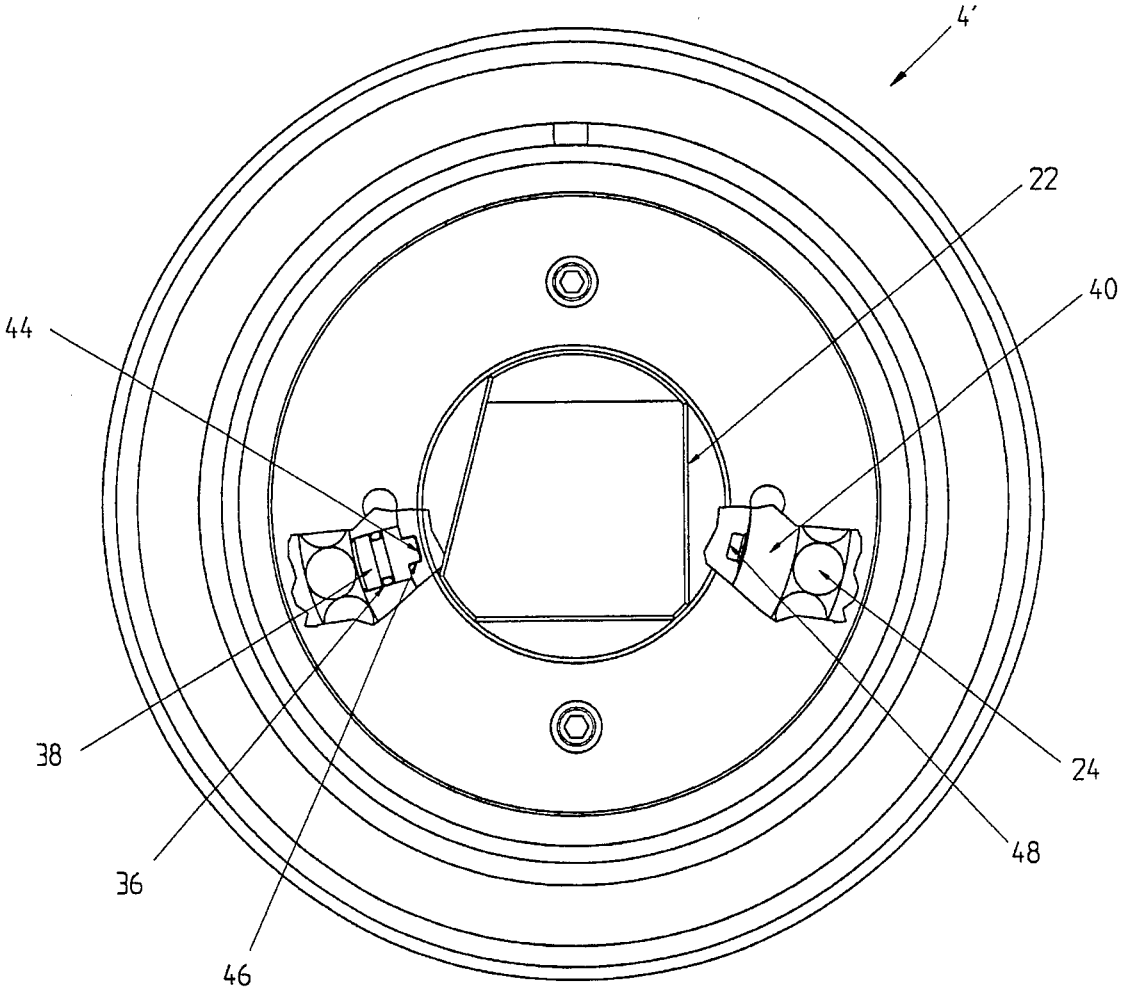
FIG. 4 is an end view of the cutter shown in FIG. 3, showing the rotatable sleeve configured in a first position.
Figure 5:
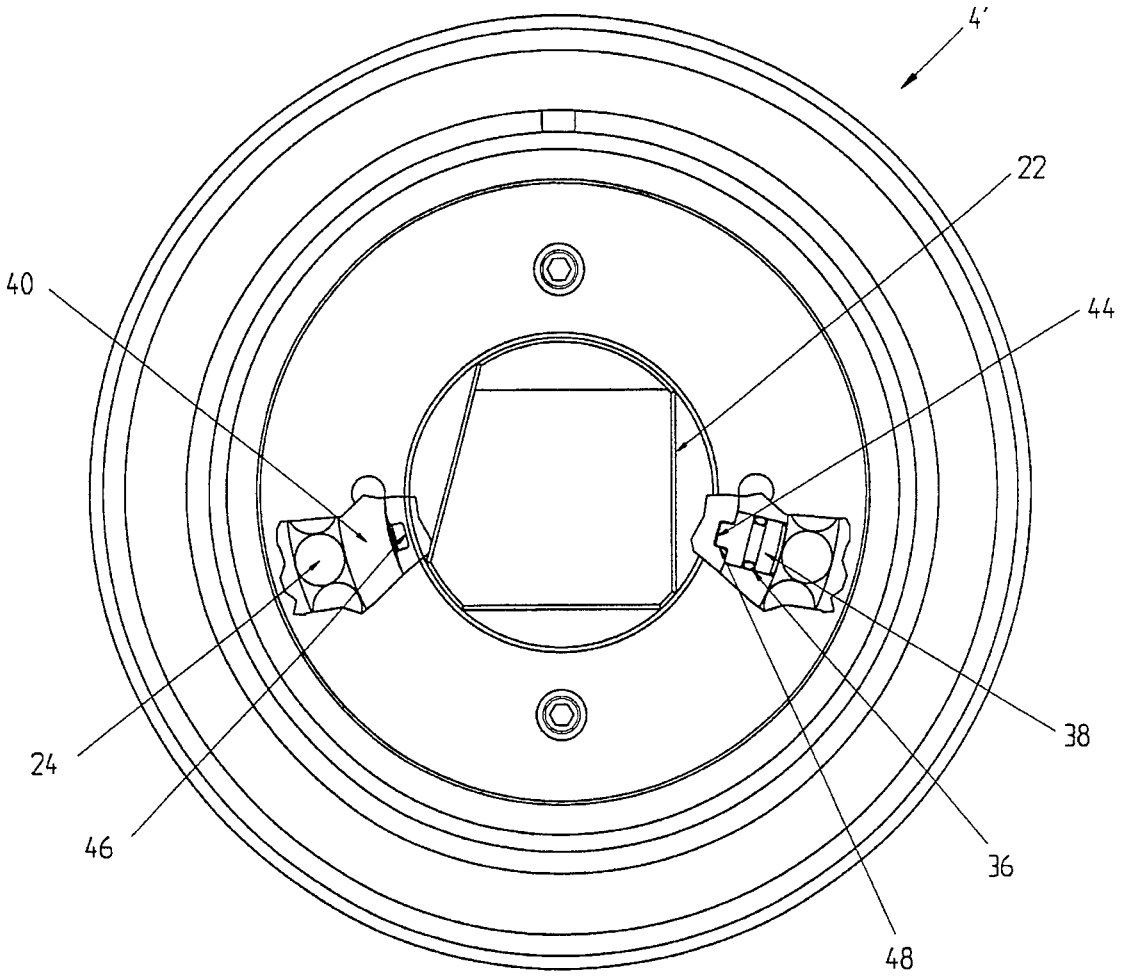
FIG. 5 is an end view of the cutter shown in FIG. 3, showing the second embodiment of FIG. 3 showing the rotatable sleeve configured in a second position.

Referring now to FIGS. 3 through 5, a second embodiment of the present invention is shown. Referring to FIG. 3, this embodiment has numerous elements in common with the first embodiment of the present invention shown in FIG. 2. For the sake of brevity, elements in FIG. 3 which are the same as those in FIG. 2 have been given the same element numbers as in FIG. 2, and the discussion of these elements in regard to FIG. 2 is incorporated herein by reference.

Unlike the first embodiment of the present invention of FIG. 2, the second embodiment of the present invention in FIG. 3 includes a sleeve 40 between shaft 22 and hubs 14 and 16. The sleeve 40 is not rotatable during use, but is rotatable between first and second positions, as described in more detail below, to reconfigure the bearing surface of the subject invention to increase the bearing life.

Unlike the first embodiment of the present invention of FIG. 2 wherein ball bearings 24 are installed through ball loading holes 36 and 37 in shaft 22 to hold hubs 14 and 16 in place, shaft 22 is not in place when ball bearings 24 are installed in the second embodiment of the present invention of FIG. 3. Thus, ball bearings 24 are loaded between hubs 14 and 16 and sleeve 40 by means of ball loading holes 36 and 37 in sleeve 40. Once the proper number of ball bearings 24 have been installed, ball plugs 38 and 39 are inserted. Ball plugs 38 and 39 have a key portion 44 thereon that protrudes into the interior surface of sleeve 40. Shaft 22 has a pair of longitudinally disposed axially extending slots 46 and 48 on the exterior surface thereof which are preferably located approximately 150° apart, or on substantially opposite sides of shaft 22. Key portions 44 of ball plugs 38 and 39 are configured to mate with one of slots 46 and 48 of shaft 22 when shaft 22 is inserted into the central opening of annular sleeve 40 in order to complete assembly of cutter assembly 4', as shown in FIGS. 4 and 5; FIG. 3 shows ball plugs 38 and 39 not oriented in mating alignment with slots 46 or 48. For example, during original assembly, as shown in FIG. 4, key portions 44 of ball plugs 38 and 39 are mated with slot 46 of shaft 22. After the cutter assembly 4' has been in service for a period of time, it will be disassembled for inspection, possible replacement of parts and lubrication. Upon reassembly, sleeve 40 can be rotated approximately 150° such that key portions 44 of ball plugs 38 and 39 now mate with slot 48 of shaft 22 as shown in FIG. 5. In this manner of rotating sleeve 40, a new bearing surface is obtained which will substantially increase the bearing life of cutter assembly 4'. It should be noted that key portions 44 is located on ball plugs 38 and 39 for the sake of convenience. However, key portions 44 need not be a part of ball plugs 38 and 39, but, instead, can be located at substantially any location on the interior diameter of sleeve 40. While two key portions 44 are shown, less or more can be employed as will be readily apparent to those skilled in the art.

In order to accommodate mating of key portions 44 of sleeve 40 with either slot 46 or slot 48 of shaft 22, shaft 22 is preferably divided into two coaxially adjoining portions, a left side L and a right side R, as shown in FIG. 3. The left side L of shaft 22 is approximately 1/100th of an inch smaller in diameter than that of the right side R of shaft 22. Likewise, the left side of the inside diameter of sleeve 40 is also 1/100th of an inch less than the inside diameter of the right side of sleeve 40. In this manner, when shaft 22 is inserted through sleeve 40, shaft 22 will penetrate approximately one-half of the distance of the sleeve 40 such that key portions 44 of ball plugs 38 and 39 can be fully engaged in either slot 46 or 48 of shaft 22 before shaft 22 has been pressed through the sleeve. Therefore, it can be insured that proper engagement of key portions 44 with either slot 46 or slot 48 has occurred prior to the pressing of shaft 22 through sleeve 40.

It is to be understood that cutter units 18 and 20 of cutter assembly 4 or 4' can be integral or insert rings comprised of, for example, steel or carbide, configured in single row or double row, or in any other configuration known in the art for use based upon the type of rock formation being cut.

The above embodiments are described simply by way of example, and are not to be construed as restrictive. The full scope of the invention is set forth in the following claims, including any and all equivalents thereof.

What is claimed is:

1. A rock cutting tool comprising:

a shaft;

at least two independently rotatable hubs on said shaft adapted for rotation about an axis of rotation with respect to a rock-face, each of said hubs having at least one cutter unit thereon; and bearing means rotatably supporting said hubs, said bearing means comprising at least one cylindrical roller bearing set and at least one ball bearing set for each of said hubs, said roller bearing set being located substantially entirely under said cutter unit to absorb radial loads, said ball bearing set being located entirely radially and axially remotely from said cutter unit to be isolated from radial loads, and said ball bearing set being located entirely under one of said hubs and located entirely remotely from the other of said hubs to minimize friction between said hubs during rotation thereof.

2. The rock cutting tool of claim 1, comprising two of said hubs.

3. The rock cutting tool of claim 2, comprising one set of ball bearings for each of said two hubs.

4. The rock cutting tool of claim 2, comprising two sets of cylindrical roller bearings for each of said two hubs.

5. A rock cutting tool comprising:

a shaft having first and second key receiving openings;

a sleeve around said shaft having an interior surface;

a rotatable hub around said sleeve, said hub supporting a cutter unit thereon;

bearing means between said sleeve and said hub; and key means on said interior surface of said sleeve, said key means being matable with said first and second key receiving openings whereby said sleeve is rotatable with respect to said shaft from a first position to a second position to disengage said key means from said first key receiving opening and engage said key means in said second key receiving opening to extend bearing surface life.

6. The rock cutting tool of claim 5, wherein said first and second key receiving openings are longitudinal slots on substantially opposite sides of said shaft.

7. The rock cutting tool of claim 5, wherein said interior of said sleeve has a bearing loading orifice.

8. The rock cutting tool of claim 7, wherein said key means is sized to fit said bearing loading orifice.

9. The rock cutting tool of claim 5, wherein said shaft has a first portion coaxially adjoining a second portion, said first portion having a larger diameter than said second portion.

10. A rock cutting tool comprising:

a shaft having first and second key receiving openings;

a sleeve around said shaft having an interior surface;

at least two independently rotatable hubs around said sleeve;

key means on said interior surface of said sleeve, said key means being matable with said first and second key receiving openings whereby said sleeve is rotatable with respect to said shaft from a first position to a second position to disengage said key means from said first key receiving opening and engage said key means in said second key receiving opening to extend bearing surface life;

at least one cutter unit on each of said hubs for rotation about an axis of rotation with respect to a rock-face; and bearing means rotatably supporting said hubs, said bearing means comprising at least one cylindrical roller bearing set and at least one ball bearing set for each of said hubs, said roller bearing set being located substantially entirely under said cutter unit to absorb radial loads, said ball bearing set being located remotely from said cutter unit to be isolated from radial loads.

11. The rock cutting tool of claim 10, comprising two of said hubs.

12. The rock cutting tool of claim 11, comprising one ball bearing set for each of said hubs.

13. The rock cutting tool of claim 11, comprising two cylindrical roller bearing sets for each of said hubs.

14. The rock cutting tool of claim 10, wherein said first and second key receiving openings are longitudinal slots on substantially opposite sides of said shaft.

15. The rock cutting tool of claim 10, wherein said interior of said sleeve has a bearing loading orifice.

16. The rock cutting tool of claim 15, wherein said key is sized to fit said bearing loading orifice.

17. The rock cutting tool of claim 10, wherein said shaft has a first portion coaxially adjoining a second portion, said first portion having a larger diameter than said second portion.

* * * * *